US011413208B2

(12) United States Patent
Baldoni et al.

(10) Patent No.: US 11,413,208 B2
(45) Date of Patent: Aug. 16, 2022

(54) KINEMATICAL CHAIN FOR ASSISTING THE MOTION OF A SPHERICAL JOINT

(71) Applicant: SCUOLA SUPERIORE DI STUDI UNIVERSITARI E DI PERFEZIONAMENTO SANT'ANNA, Pisa (IT)

(72) Inventors: Andrea Baldoni, Pisa (IT); Matteo Fantozzi, Viareggio (IT); Simona Crea, Lucca (IT); Francesco Giovacchini, Pisa (IT); Nicola Vitiello, Pontedera (IT); Marco Cempini, Miami, FL (US); Dario Marconi, Pisa (IT); Mario Cortese, Pisa (IT)

(73) Assignee: SCUOLA SUPERIORE DI STUDI UNIVERSITARI E DI PERFEZIONAMENTO SANT'ANNA, Pisa (IT)

( * ) Notice: Subject to any disclaimer, the term of this patent is extended or adjusted under 35 U.S.C. 154(b) by 304 days.

(21) Appl. No.: 16/616,580

(22) PCT Filed: Jul. 10, 2018

(86) PCT No.: PCT/IB2018/055085
§ 371 (c)(1),
(2) Date: Nov. 25, 2019

(87) PCT Pub. No.: WO2019/012429
PCT Pub. Date: Jan. 17, 2019

(65) Prior Publication Data

US 2021/0145687 A1 May 20, 2021

(30) Foreign Application Priority Data

Jul. 13, 2017 (IT) ..... 102017000079086

(51) Int. Cl.
*A61H 1/00* (2006.01)
*A61H 1/02* (2006.01)

(52) U.S. Cl.
CPC ... *A61H 1/0288* (2013.01); *A61H 2201/0192* (2013.01); *A61H 2201/165* (2013.01); *A61H 2201/1673* (2013.01)

(58) Field of Classification Search
CPC ..... A61H 1/0288; A61H 2201/0192; A61H 2201/165; A61H 2201/1673; A61H 1/0281; B25J 9/0006
See application file for complete search history.

(56) References Cited

U.S. PATENT DOCUMENTS 7,862,524 B2 * 1/2011 Carignan ..... B25J 17/025 601/5
2003/0223844 A1 12/2003 Schiele et al.
(Continued)

FOREIGN PATENT DOCUMENTS

JP 2009219804 A 10/2009
WO 2013/186701 A1 12/2013

OTHER PUBLICATIONS

International Search Report corresponding to International Application No. PCT/IB2018/055085, dated Dec. 17, 2018.

*Primary Examiner* — Samchuan C Yao
*Assistant Examiner* — Sarah B Lederer
(74) *Attorney, Agent, or Firm* — Ladas & Parry LLP; Malcolm J. MacDonald

(57) ABSTRACT

A kinematical chain (100) for assisting a spherical motion of an anatomical joint (200) of a finger of the hand (210) of a user, said anatomical joint (200) having centre of rotation P and being arranged for allowing a relative motion of a finger of the hand (210) with respect to a portion of hand (220) of
(Continued)

the user, said finger of the hand (210) defining a longitudinal direction δ. The kinematical chain (100) comprises a first rotational joint (110) engaged to the finger of the hand (210) and to a first connection link (115), said first rotational joint (110) arranged to provide a relative rotation α between the first connection link (115) and the finger of the hand (210) about a rotation axis x coincident with the longitudinal direction δ. The kinematical chain (100) also comprises a third rotational joint (130) engaged to the portion of hand (220) and to a second connection link (125), said third rotational joint (130) arranged to provide a relative rotation γ between the second connection link (125) and the portion of hand (220) about a rotation axis z integral to the portion of hand (220). The kinematical chain (100) comprises then a second rotational joint (120) engaged to the first connection link (115) and to the second connection link (125), said second rotational joint (120) arranged to provide a relative rotation β between the first connection link (115) and the second connection link (125) about a rotation axis y. The rotation axes x, y and z intersect in a centre of rotation O, in such a way that the kinematical chain (100) allows a spherical motion of the longitudinal direction δ with respect to the portion of hand (220) about the centre of rotation P.

9 Claims, 9 Drawing Sheets

(56) References Cited

U.S. PATENT DOCUMENTS

| | | | | |
|---|---|---|---|---|
| 2013/0237883 | A1 | 9/2013 | Malosio et al. | |
| 2015/0148728 | A1 | 5/2015 | Sallum et al. | |
| 2015/0223959 | A1* | 8/2015 | Cempini ..... | A61F 5/013 602/22 |
| 2016/0206497 | A1 | 7/2016 | Deshpande et al. | |
| 2016/0252110 | A1 | 9/2016 | Galloway et al. | |

* cited by examiner

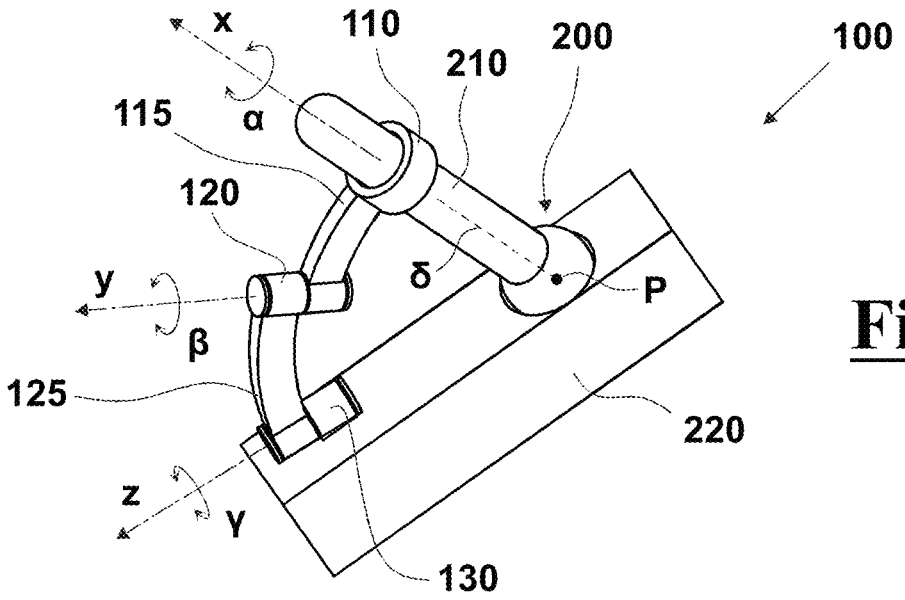
Fig. 1A
Fig. 1B
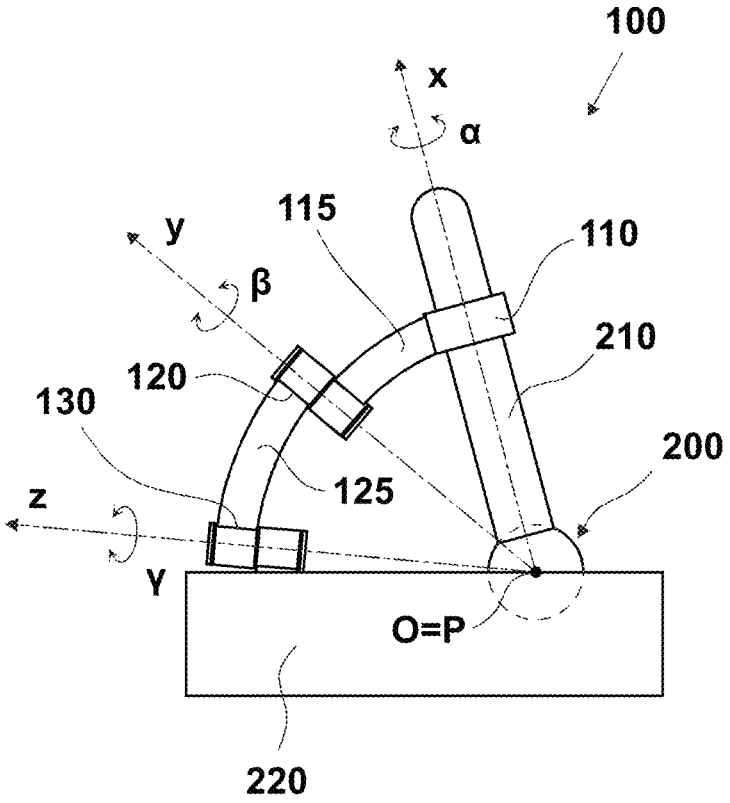

KINEMATICAL CHAIN FOR ASSISTING THE MOTION OF A SPHERICAL JOINT

FIELD OF THE INVENTION

The present invention relates to the field of motor assistance and rehabilitation of anatomical parts.

In particular, the invention relates to a kinematic chain for assisting a spherical motion of an anatomic joint of a finger of the hand.

DESCRIPTION OF THE PRIOR ART

The exoskeletons proposed in the literature are generally designed according to two main approaches, sometimes in part interconnected.

A first category, widely used for example in the case of exoskeletons for the hand, is that of the so-called "soft" exoskeletons, devices consisting of flexible elements (eg gloves) that can be easily worn, in which some elements also "soft" are used as anchorage of the glove to the various segments of the hand (or other organ) and connected to the actuation system (usually with cables or based on pneumatic actuators). These devices are particularly suitable when the forces involved are not high and when you do not want to accurately measure the patient's performance in the execution of the motion (for example in terms of applied force or articular kinematics).

The second category consists of "rigid" exoskeleton, i.e. robotic devices consisting of a series of active and/or passive joints and links that are engaged to the person by means of specially designed shells (rigid or semi-rigid). This type of architecture allows to apply high forces or torques (in the order of magnitude appropriate for the treatment of spasticity, for example) and to quantify the performance of the patient in a precise and repeatable manner without generating unwanted forces on the anatomical joint. In this case, the robot must at the same time allow the patient to perform the motion autonomously when possible (resulting yielding and not rigid at the interface with the patient's hand), or apply the necessary forces/couples to complete the motion when the person fails to do so (in this case then resulting in a rigid interface).

As regards, in particular, the anatomical joints that perform spherical motions, such as the articulation of the thumb or shoulder, the technological challenge is to develop structures able to simultaneously reproduce the joint motion without generating parasitic reactions, adapt to different anthropometric sizes, have a small footprint and also achieve a rigid or yielding man-robot interaction depending on the need for rehabilitation treatment.

In U.S. Pat. No. 7,862,524 an exoskeletal rehabilitative apparatus is presented that is able to assist the rotation motion of the shoulder, using three rotational joints having orthogonal axes to each other and accidents at the scapulohumeral joint. Some passive joints are then provided to adapt the exoskeleton to different anthropometric measurements of the arm and shoulder. The interaction of forces between the exoskeleton and the user occurs at the elbow and at the hand grip.

The intersection of the axes of the rotational joints at the shoulder joint allows, theoretically, to reproduce the spherical motion, without producing parasitic reactions.

However, in practice, the alignment between the point of intersection between the rotation axes of the joints and the center of rotation of the anatomic articulation is not absolutely trivial to be obtained without the presence of adequate regulation systems. This problem is further amplified if one wishes to use the same kinematic principle to assist the spherical motion of the articulation of the thumb of a hand. The document U.S. Pat. No. 7,862,524 provides the possibility of adapting passively to different lengths of the arm and the forearm, but does not in any way deal with the problem of alignment between the two centers of rotation mentioned above, being in fact not very effective in the practical application of the theoretical principle.

SUMMARY OF THE INVENTION

It is therefore a feature of the present invention to provide a kinematical chain for assisting a spherical motion of an anatomical joint of a finger of the hand of a user for which allows to reproduce this spherical motion without generating parasitic forces.

It is also a feature of the present invention to provide such a kinematical chain that is adaptable to different anthropometric measurements of a user.

It is also a feature of the present invention to provide such a kinematical chain which allows to easily and effectively align the center of rotation of the kinematic chain with that of the anatomic joint.

It is still a feature of the present invention to provide an hand exoskeleton which implements this kinematic chain to assist the spherical motion of a carpo-metacarpal joint of the thumb.

These and other objects are achieved by a kinematical chain for assisting a spherical motion of an anatomical joint of a finger of the hand of a user, said anatomical joint having centre of rotation P and being arranged for allowing a relative motion of a finger of the hand with respect to a portion of hand of the user, said finger of the hand defining a longitudinal direction $\delta$, said kinematical chain comprising:

- a first rotational joint engaged to the finger of the hand to a first connection link, said first rotational joint arranged to provide a relative rotation $\alpha$ between the first connection link and the finger of the hand (210) about a rotation axis x coincident with the longitudinal direction $\delta$;
- a third rotational joint engaged to the portion of hand to a second connection link, said third rotational joint arranged to provide a relative rotation $\gamma$ between the second connection link and the portion of hand about a rotation axis z integral to the portion of hand;
- a second rotational joint engaged to the first connection link and to the second connection link, said second rotational joint arranged to provide a relative rotation $\beta$ between the first connection link and the second connection link about a rotation axis y;
- whose main feature is that the rotation axes x, y and z intersect in a centre of rotation O, in such a way that the kinematical chain allows a spherical motion of the longitudinal direction $\delta$ with respect to the portion of hand about the centre of rotation P.

Advantageously, an adjustment means is provided arranged to adjust the direction of the rotation axes x, y and z for bringing the centre of rotation O substantially at the centre of rotation P, in such a way that the kinematical chain carries out the spherical relative motion between the longitudinal direction $\delta$ and the portion of hand (220) about the anatomical joint without generating parasitic forces on the user.

In particular, the adjustment means comprises at least two threaded fasteners arranged to adjust its own height for adjusting the relative position between the centre of rotation O and the centre of rotation P of the anatomical joint.

Alternatively, the adjustment means comprises a plate comprising a first flat portion and a second flat portion orthogonal to each other, said first flat portion comprising a first couple of circular slots arranged to allow a rotation of the third rotational joint with respect to the portion of hand about an axis orthogonal to the first flat portion, said second flat portion comprising a second couple of circular slots arranged to allow a rotation of the third rotational joint with respect to the portion of hand about an axis orthogonal to the second flat portion.

According to another aspect of the invention, an hand exoskeleton is claimed for assistance to a spherical motion of a carpo-metacarpal joint of the thumb of a user, said hand exoskeleton comprising:

- a kinematical chain according to claim 1, said finger of the hand corresponding to the thumb of the user and said portion of hand corresponding to the carpal portion of the hand of the user;
- a frame integral to the back of the hand of the user;
- whose main feature is that the first rotational joint engages with the thumb and that the third rotational joint engages with the back of the hand by the frame.

Advantageously, the hand exoskeleton comprises furthermore:

- a thumb exoskeleton arranged to assist a flexion/extension motion of a thumb of the user;
- an index exoskeleton integral to the frame and arranged to assist a flexion/extension motion of an index of the user.

In particular, an exoskeleton for fingers is also comprised arranged to assist a flexion/extension motion of a middle finger, a ring finger and a little finger of the user.

Advantageously, an orthotic shell is also comprised arranged to engage the hand exoskeleton to the hand of the user, said orthotic shell comprising:

- a plurality of interchangeable mesh straps arranged to wind the hand;
- two rotating joints arranged to allow a relative rotation between a first group of interchangeable mesh straps and a second group of interchangeable mesh straps;
- in such a way to allow the orthotic shell to fit to different anthropometric measures of the hand of the user.

In particular, the thumb exoskeleton and the index exoskeleton are integral to the phalanxes, respectively, of the thumb and of the index by means of rings wearable on the fingers and having at least one pin and a magnet arranged to engage with the exoskeletons. The magnet ensures the contact between the ring and the exoskeleton, whereas the pin allows to fasten the position of contact. In order to avoid the relative rotation between the ring and the exoskeleton also can be provided a second pin or a slide.

According to a further aspect of the invention, an orthotic shell is claimed arranged to engage with the hand exoskeleton to the hand of a user, said orthotic shell comprising:

- a plurality of interchangeable mesh straps arranged to wind the hand;
- two rotating joints for a relative rotation between a first group of interchangeable mesh straps and a second group of interchangeable mesh straps;
- in such a way to allow the orthotic shell to fit to different anthropometric measures of the user.

BRIEF DESCRIPTION OF THE DRAWINGS

Further characteristic and/or advantages of the present invention are more bright with the following description of an exemplary embodiment thereof, exemplifying but not limitative, with reference to the attached drawings in which:

FIG. 1A shows a perspective view of a schematic embodiment of the kinematical chain according to the present invention;

FIG. 1B shows a front view of the exemplary embodiment of FIG. 1A;

DESCRIPTION OF A PREFERRED EXEMPLARY EMBODIMENT

Figure 2:
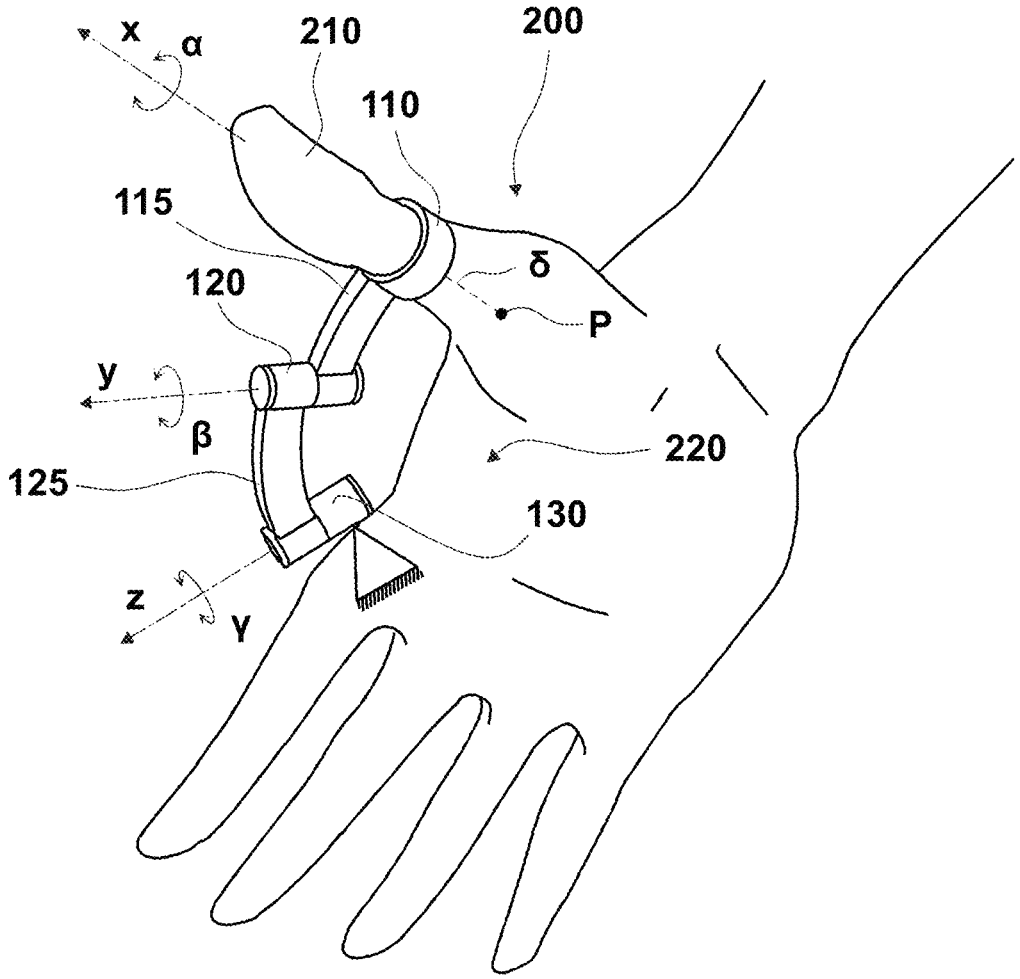
FIG. 2 shows the kinematical chain of FIGS. 1A and 1B applied to the thumb of a user.

In the FIGS. 1A and 1B is shown a kinematical chain 100 for assisting a spherical motion of an anatomical joint 200, according to the present invention, applied to a generic finger of the hand.

The anatomical joint 200 allows a spherical rotation of the finger of the hand 210 with respect to a portion of hand 220 about its own centre of rotation P.

The kinematical chain 100 comprises a first rotational joint 110 engaged to the finger of the hand 210 and to a first connection link 115. The first rotational joint 110 is arranged to provide a relative rotation $\alpha$ between the first connection link 115 and the finger of the hand 210 about a rotation axis x coincident with the longitudinal direction $\delta$ defined by the finger of the hand 210 itself. In particular, the rotational joint 110 comprises an inner ring, integral to the finger of the hand 210, and an outer ring, integral to the connection link 115, and arranged to rotate with respect to the inner ring.

The kinematical chain 100 comprises then a second rotational joint 120, engaged to the first connection link 115 and to a second connection link 125, and arranged to provide a relative rotation $\beta$ between the two links about a rotation axis y.

The kinematical chain 100 comprises then a third rotational joint 130, engaged to the portion of hand 220 and to the second connection link 125, and arranged to provide among them a relative rotation $\gamma$ about a rotation axis z integral to the portion of hand 220.

In particular, the rotation axes x, y and z intersect in a centre of rotation O coincident with the centre of rotation P of the anatomical joint 200.

This way, the kinematical chain provides a spherical rotation of the rotation axis x with respect to the portion of hand 220, allowing to follow the spherical rotation of the finger of the hand 210 and to assist it, if the joints are active, without generating unwanted forces neither on the finger of the hand 210 itself, nor on the portion of hand 220, nor on the articulation.

In FIG. 2 is shown the kinematical chain 100 of FIGS. 1A and 1B applied, in particular, to the thumb finger of a user, in such a way that the finger of the hand 210 corresponds to the thumb of the user and the portion of hand 220 corresponds to the palm of the hand of the hand of the user.

Figure 3:
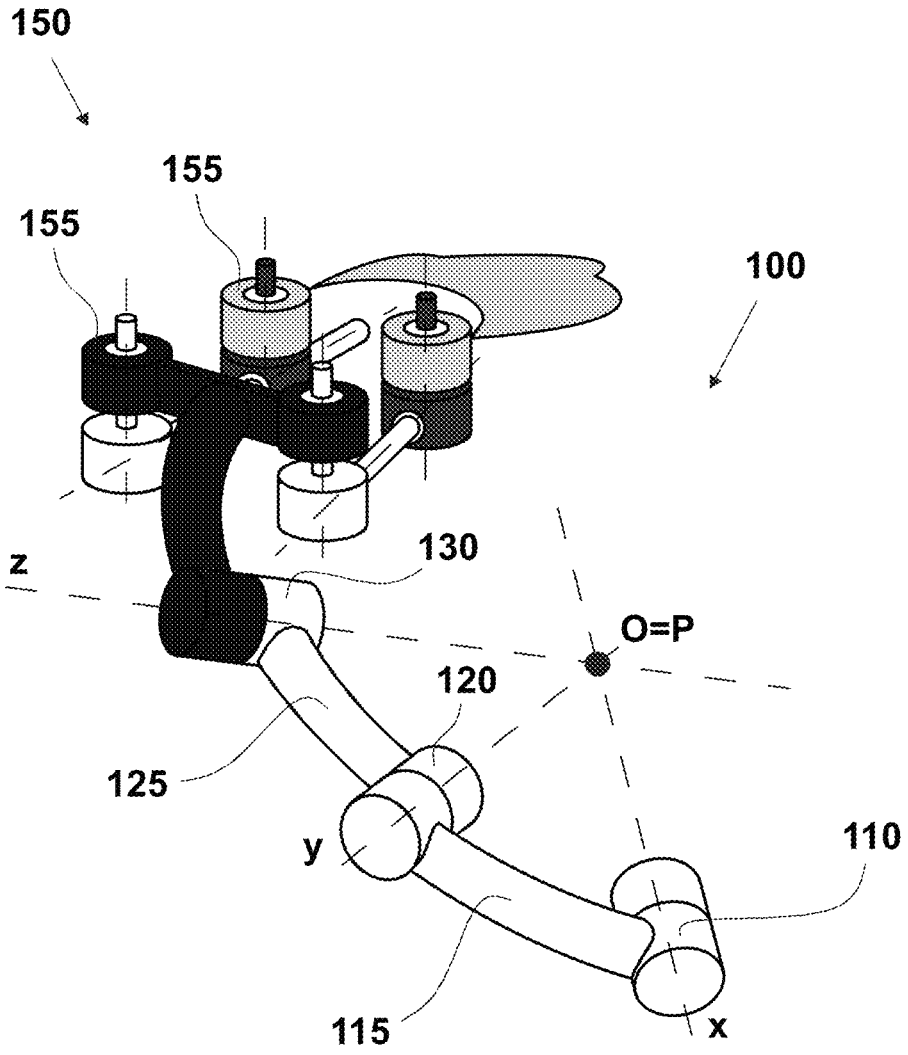
FIG. 3 shows schematically the kinematical chain according to the present invention equipped with the adjustment means.

With reference to FIG. 3, in an exemplary embodiment of the present invention, the kinematical chain 100 also comprises adjustment means 150 arranged to adjust the direction of the rotation axes x, y and z to assist the coincidence between the centre of rotation O and the centre of rotation P.

In particular, the adjustment means 150 comprises four threaded fasteners 155 arranged to adjust its own height for adjusting the relative position between the intersection of the axes rotation x, y and z, i.e. the centre of rotation O, and the centre of rotating the anatomical joint P.

Figure 4:
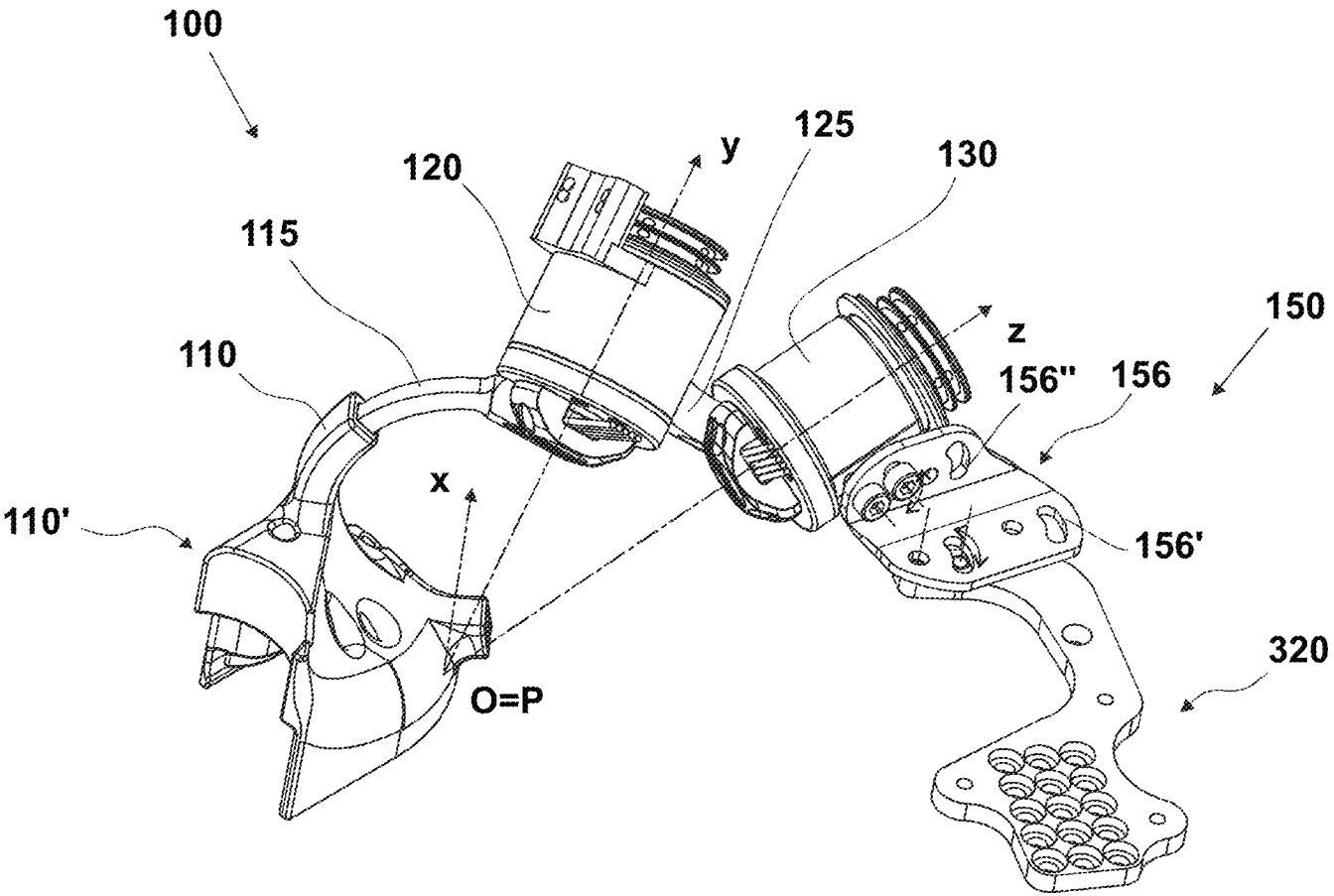
FIG. 4 shows a possible exemplary embodiment of the kinematical chain according to the present invention equipped with adjustment means alternative to those of FIG. 3.

In FIG. 4 a possible exemplary embodiment is shown of the kinematical chain 100 which can be fixed to an exoskeleton of hand, according to the present invention, equipped with adjustment means 150 alternative to those of FIG. 3.

In particular, the first rotational joint 110 engages with the thumb by the orthotic shell 110'.

In particular, the adjustment means 150 comprises a plate 156 located between the third rotational joint 130 and a frame 320 arranged to be integral to the portion of hand 220, i.e. With the carpal portion of the hand of the user. Such plate 156 comprises two flat portions located at 90° to each other, on which are provided, respectively, a first couple of circular slots 156' and a second couple of circular slots 156". The elongated holes 156' and 156" allow the third rotational joint 130 of the kinematical chain 100 of having a degree of freedom, respectively, in the angle of "yaw" and of "pitch" with respect to the orthotic shell fastening to the palm of the hand.

Furthermore, the kinematical chain may comprise a variation means for adjusting the length of the connection link 115 and 125 and conform the kinematical chain to different measuring the hand (not shown in figure for the sake of clearness of drawing). For example, the link 115 and 125 can be telescopic or connected to the adjacent rotational joints by means of elongated holes that allow a relative translation.

Figure 5:
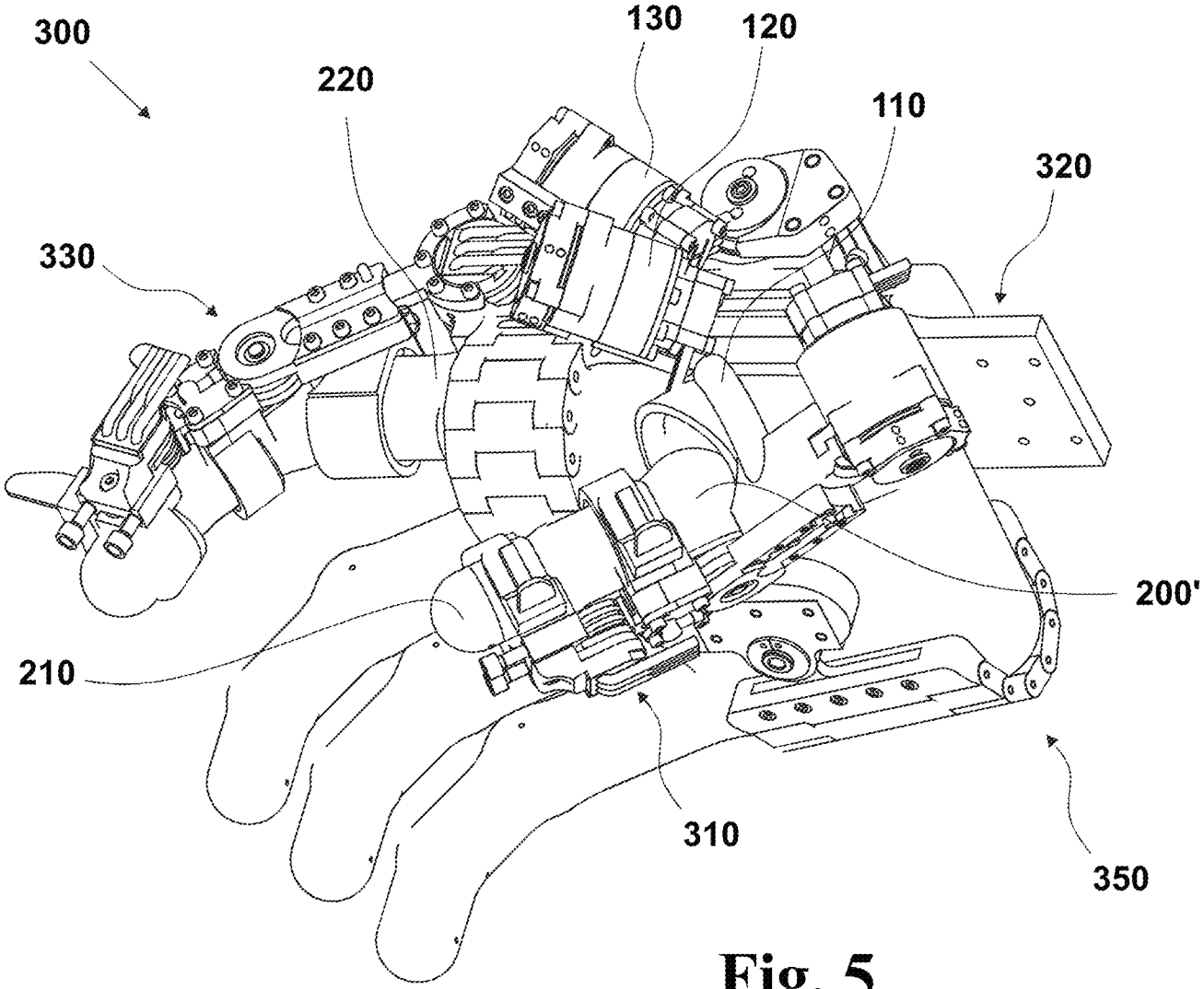
FIG. 5 shows in a first perspective view an exemplary embodiment of the exoskeleton of hand according to the present invention.
Figure 6:
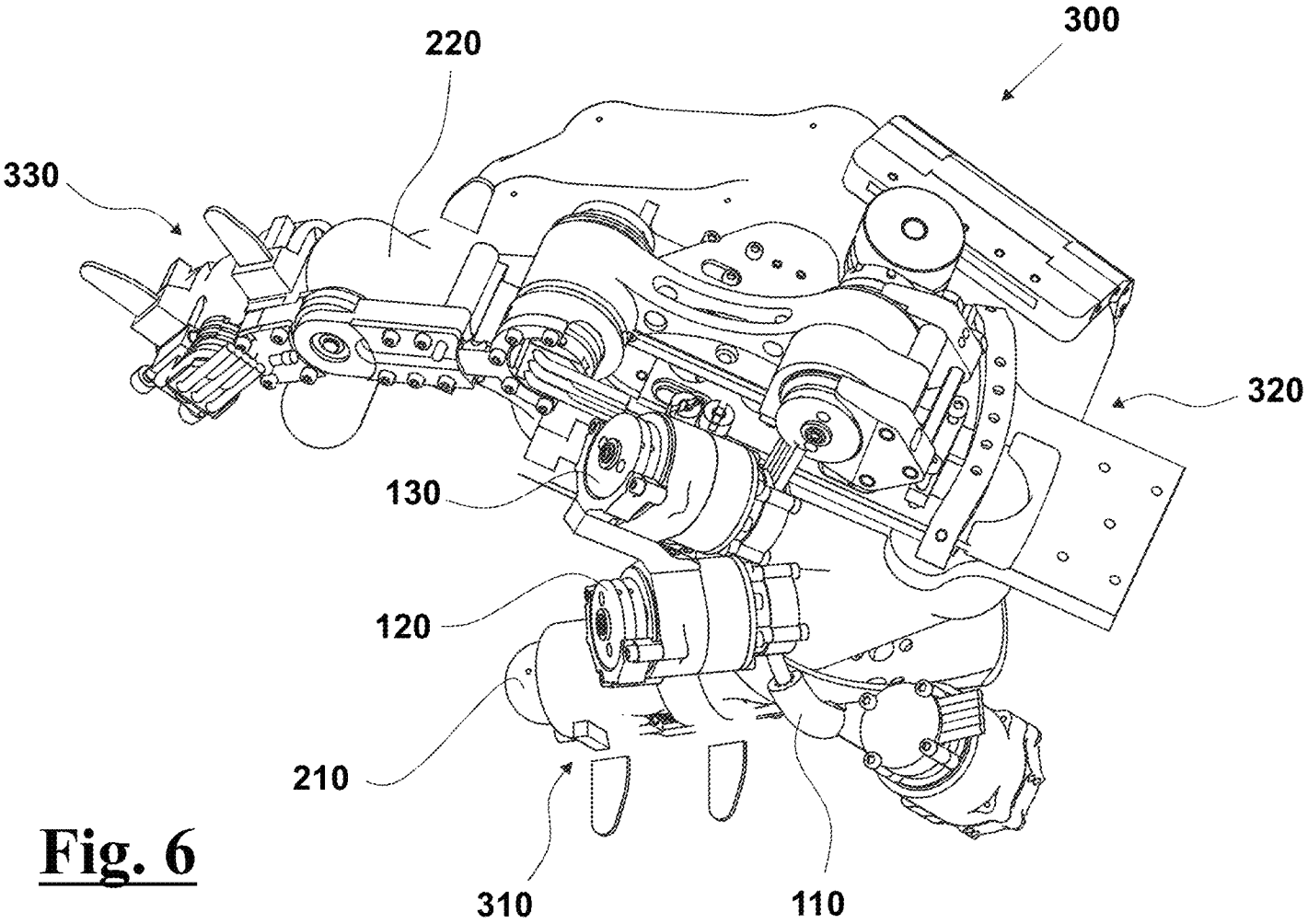
FIG. 6 shows in a second perspective view the exemplary embodiment of the exoskeleton of hand of FIG. 5.

In the FIGS. 5 and 6 is shown, according to two different perspective views, a first exemplary embodiment of a hand exoskeleton 300 for assistance to a spherical motion of a carpo-metacarpal joint 200' of the thumb of a user, according to the present invention. On this exoskeleton 300 the kinematical chain 100 of FIG. 4 is implemented in such a way that the finger of the hand 210 corresponds to the thumb of the user and the portion of hand 220 corresponds to the palm of the hand of the hand of the user.

In particular, the exoskeleton 300 comprises, in addition to the kinematical chain 100, a frame 320 integral to the back of the hand of the user, in order to allow an engagement the third rotational joint 130 to the back of the hand.

The exoskeleton 300 also comprises a thumb exoskeleton 310, which is adapted to assist the motion of flexion/extension of the thumb of the user, and an index exoskeleton 330 integral to the frame 320 and arranged to assist the motion of flexion/extension of the index of the user. In particular, the first rotational joint 110 engages with the thumb exoskeleton 310.

Still with reference to an exemplary embodiment of FIGS. 5 and 6, the exoskeleton 300 also comprises an orthotic shell 350 arranged to engage the exoskeleton 300 itself to the hand of the user.

Figure 7:
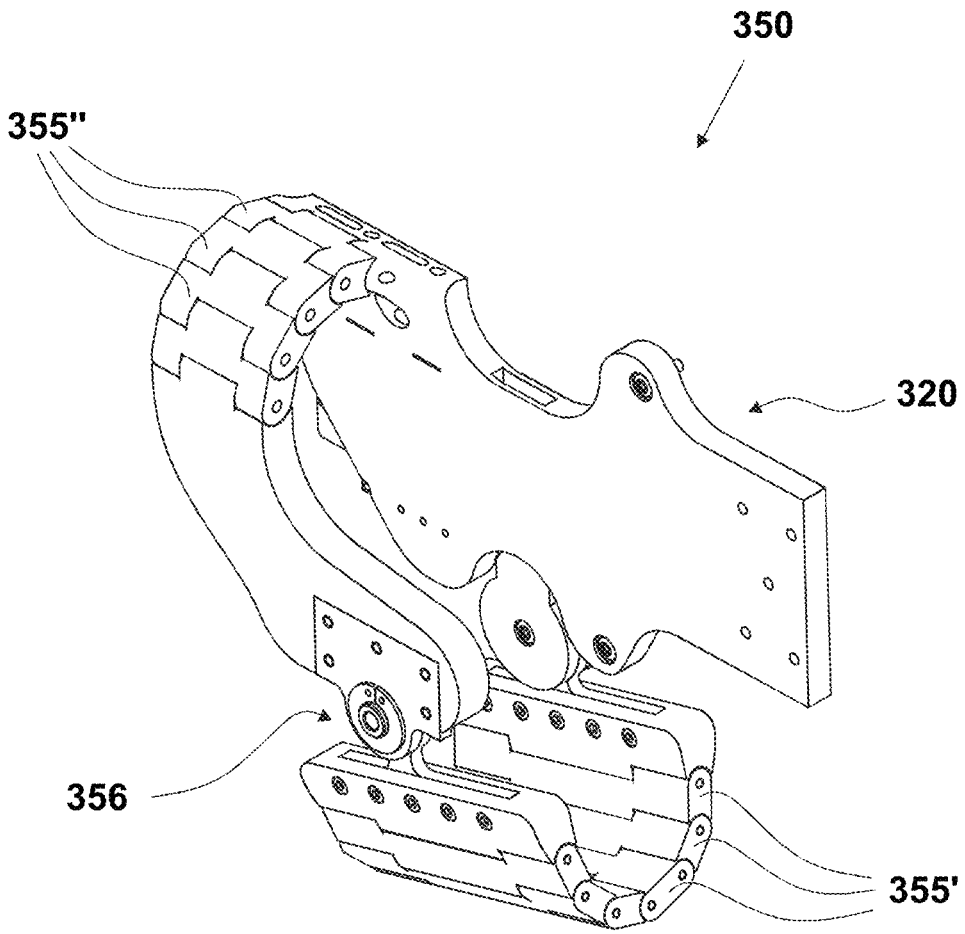
FIG. 7 shows an exemplary embodiment of the orthotic shell for fastening to the hand.

In particular, in FIG. 7 the orthotic shell 350 comprises a plurality of interchangeable mesh straps arranged to wind the hand and two rotating joints 356 arranged to allow a relative rotation between a first unit 355' of interchangeable mesh straps 355 and a second unit 355" of interchangeable mesh straps 355. This way, the orthotic shell 350 can adapt to different anthropometric measures of the user.

Figure 8:
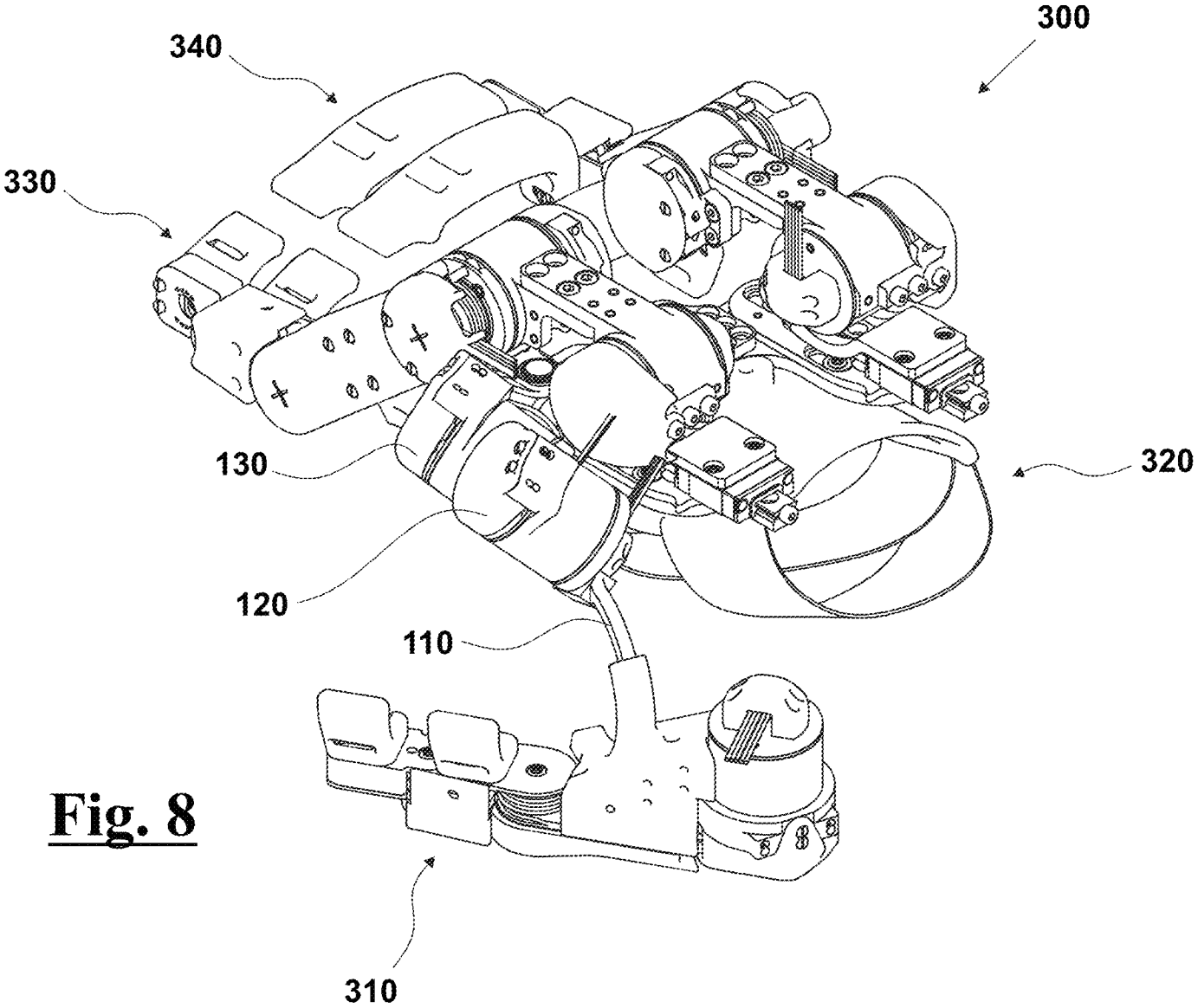
FIG. 8 shows a perspective view of a second exemplary embodiment of the exoskeleton of hand according to the present invention.

With reference to FIG. 8, in a second exemplary embodiment, the hand exoskeleton 300 also comprises an exoskeleton for fingers 340 arranged to assist a flexion/extension motion of the middle finger, of the ring finger and of the little finger of the user.

In the exemplary embodiment of FIG. 9, moreover, the exoskeleton 300 comprises an alternative exemplary embodiment of the orthotic shell, much easier and cheap with respect to that of FIG. 7.

Figure 9A:
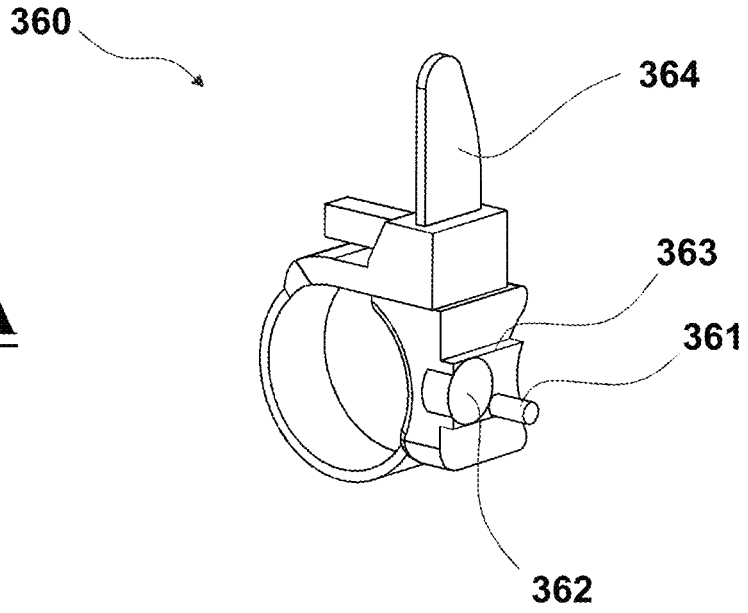
FIGS. 9A and 9B show two exemplary embodiments of the rings arranged to constrain the exoskeletons for fingers to the fingers.
Figure 9B:
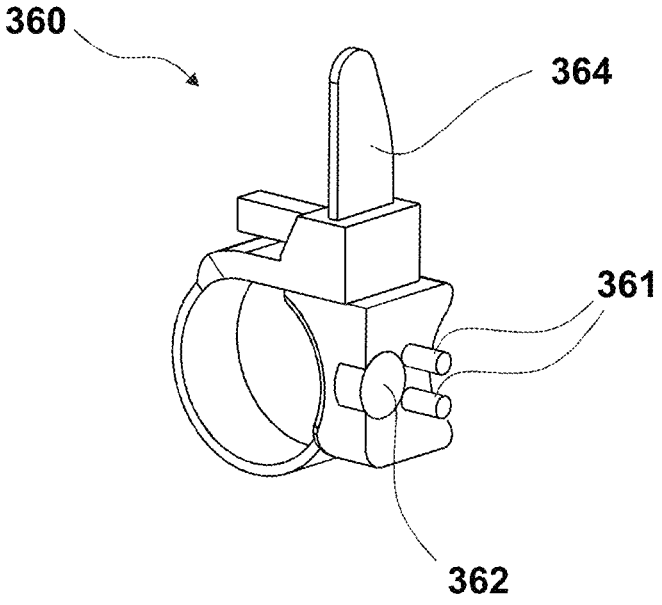

In the FIGS. 9A and 9B two exemplary embodiments of the rings 360 are shown arranged to constrain the exoskeletons for fingers 310,330 to the fingers itself.

In particular, in FIG. 9A the ring 360 comprises a magnet 362 arranged to avoid the disengagement between ring 360 and exoskeleton 310,330. The ring 360 also comprises a pin 361, which is adapted to enter a housing of the exoskeleton, and a step 363. The pin 361 and the step 363 synergically prevent the relative motion between the ring 360 and the exoskeleton 310,330, ensuring then the transmission of the motion of flexion/extension.

In FIG. 9B the ring comprises, instead of the step 363, a second pin 361 that, with the first pin 361, prevents from a relative rotation.

In both the exemplary embodiments of FIGS. 9A and 9B a band 364 is also comprised arranged to adjust the grip on the finger according to the measure of the finger itself.

The foregoing description some exemplary specific embodiments will so fully reveal the invention according to the conceptual point of view, so that others, by applying current knowledge, will be able to modify and/or adapt in various applications the specific exemplary embodiments without further research and without parting from the invention, and, accordingly, it is meant that such adaptations and modifications will have to be considered as equivalent to the specific embodiments. The means and the materials to realise the different functions described herein could have a different nature without, for this reason, departing from the field of the invention. it is to be understood that the phraseology or terminology that is employed herein is for the purpose of description and not of limitation.

The invention claimed is:

1. A kinematical chain (100) for assisting a spherical motion of an anatomical joint (200) of a finger of the hand (210) of a user, said anatomical joint (200) having centre of rotation P and being configured to allow a relative motion of said finger of the hand (210) with respect to a portion of hand (220) of said user, said finger of the hand (210) defining a longitudinal direction δ, said kinematical chain (100) comprising:

a first rotational joint (110) configured to engage said finger of the hand (210) and to a first connection link (115), said first rotational joint (110) arranged to provide a relative rotation a between said first connection link (115) and said finger of the hand (210) about a rotation axis x coincident with said longitudinal direction δ;

a third rotational joint (130) configured to engage said portion of hand (220) and to a second connection link (125), said third rotational joint (130) arranged to provide a relative rotation y between said second connection link (125) and said portion of hand (220) about a rotation axis z integral to said portion of hand (220);

a second rotational joint (120) configured to engage said first connection link (115) and to said second connection link (125), said second rotational joint (120) arranged to provide a relative rotation R between said first connection link (115) and said second connection link (125) about a rotation axis y; said kinematical chain (100) characterized in that said rotation axes x, y and z intersect in a centre of rotation O, said kinematical chain (100) allowing a spherical motion of said longitudinal direction δ with respect to said portion of hand (220) about said centre of rotation P.

2. The kinematical chain (100), according to claim 1, further comprising an adjustment means configured to adjust the direction of said rotation axes x, y and z for bringing said centre of rotation O substantially at said centre of rotation P, in such a way that said kinematical chain (100) carries out said spherical relative motion between said longitudinal direction δ and said portion of hand (220) about said anatomical joint (200) without generating parasitic forces on said user.

3. The kinematical chain (100), according to claim 2, wherein said adjustment means (150) comprises at least two threaded fasteners (155) arranged to adjust its own height for adjusting the relative position between said centre of rotation O and said centre of rotation P of the anatomical joint.

4. The kinematical chain (100), according to claim 2, wherein said adjustment means (150) comprises a plate (156) comprising a first flat portion and a second flat portion orthogonal to each other, said first flat portion comprising a first couple of circular slots (156') configured to allow a rotation of said third rotational joint (130) with respect to said portion of hand (220) about an axis orthogonal to said first flat portion, said second flat portion comprising a second couple of circular slots (156") configured to allow a rotation of said third rotational joint (130) with respect to said portion of hand (220) about an axis orthogonal to said second flat portion.

5. A hand exoskeleton (300) for assistance to a spherical motion of a carpo-metacarpal joint (200) of the thumb of a user, said hand exoskeleton (300) comprising: the kinematical chain (100) according to claim 1, said finger of the hand (210) corresponding to the thumb of said user and said portion of hand (220) corresponding to the carpal portion of the hand of said user; a frame (320) configured to engage the back of the hand of said user; said hand exoskeleton (300) characterized in that said first rotational joint (110) is configured to engage with said thumb, and in that said third rotational joint (130) is configured to engage with said back of the hand by said frame (320).

6. The hand exoskeleton (300), according to claim 5, further comprises a thumb exoskeleton (310) configured to assist a flexion/extension motion of a thumb of said user; an index exoskeleton (330) integral to said frame (320) and configured to assist a flexion/extension motion of an index of said user.

7. The hand exoskeleton (300), according to claim 5, further comprising an exoskeleton for fingers (340) is configured to assist a flexion/extension motion of a middle finger, a ring finger and a little finger of said user.

8. The hand exoskeleton (300), according to claim 5, which further comprises an orthotic shell (350) configured to engage said hand exoskeleton (300) to the hand of said user, said orthotic shell (350) comprising: a plurality of interchangeable mesh straps arranged to wind said hand; two rotating joints (356) configured to allow a relative rotation between a first group (355') of interchangeable mesh straps and a second group (355") of interchangeable mesh straps in such a way to allow said orthotic shell (350) to fit to different anthropometric measures of said hand of said user.

9. The hand exoskeleton (300), according to claim 6, wherein said thumb exoskeleton (310) and said index exoskeleton (330) are configured to engage to the phalanxes, respectively, of said thumb and of said index by means of rings (360) wearable on said index and thumb fingers and having at least one pin (361) and further comprises a magnet (362) configured to engage with said thumb and index exoskeletons (310,330).

* * * * *